US006347615B1

(12) United States Patent
Höpfl et al.

(10) Patent No.: US 6,347,615 B1
(45) Date of Patent: Feb. 19, 2002

(54) DAMPER FOR TAP-CHANGER VACUUM SWITCH

(75) Inventors: Klaus Höpfl, Maxhütte-Haidhof; Silke Wrede, Zeitlarn, both of (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 09/610,517

(22) Filed: Jul. 6, 2000

(30) Foreign Application Priority Data

Jul. 22, 1999 (DE) ..... 199 34 383

(51) Int. Cl.[7] ..... F02M 7/00
(52) U.S. Cl. ..... 123/447; 137/540
(58) Field of Search ..... 188/297–306; 137/540; 123/447, 90.11

(56) References Cited

U.S. PATENT DOCUMENTS 3,553,395 A 1/1971 White
4,430,535 A 2/1984 Berg
5,107,200 A 4/1992 Dohnal
5,769,402 A * 6/1998 Ide et al. ..... 267/140.14
6,106,078 A * 8/2000 Johnston et al. ..... 303/2
6,158,470 A * 12/2000 Ivers et al. ..... 137/807
6,213,094 B1 * 4/2001 Onichi et al. ..... 123/447

FOREIGN PATENT DOCUMENTS

DE 4402087 8/1995
JP 57-9622 * 2/1982

* cited by examiner

*Primary Examiner*—Lincoln Donovan
(74) *Attorney, Agent, or Firm*—Herbert Dubno; Andrew Wilford

(57) ABSTRACT

A tap-changer vacuum switch having an actuating rod extending and displaceable along an axis is provided with a damper having a damper housing offset from and fixed relative to the vacuum switch, and a rod piston fixed on the valve-actuating rod, in the damper housing, and defining in the damper housing a compartment whose volume changes as the rod piston moves axially with the rod. The damper housing is formed with a pair of radially open ports opening into the compartment. An in-only check valve fitted to one of the ports only permits fluid flow into the compartment, and an out-only check valve fitted to the other port only permits fluid flow out of the compartment.

2 Claims, 3 Drawing Sheets

DAMPER FOR TAP-CHANGER VACUUM SWITCH

FIELD OF THE INVENTION

The present invention relates to a damper. More particularly this invention concerns a damper used on the actuating rod of a vacuum switch of a tap changer.

BACKGROUND OF THE INVENTION

Vacuum switches, also known as vacuum switching cells, are used in high-current applications as they avoid the arcing and burning problems of contacts that are switched, even if in a bath of dielectric oil. Such switches are particularly useful in tap changers which make and break connections while under considerable load.

A force-storage unit is typically provided to operate an actuating rod of such a vacuum cell rapidly at an exactly predetermined time in the switching cycle. The actuating rod must be moved perfectly accurately to avoid stress to the bellows connecting it to the envelope of the vacuum switch. Furthermore the actuating movement must, on opening of the vacuum switch, start brusquely to separate possible welded contacts, but must close gently to avoid overtravel and damage to the switch. In order to achieve such carefully controlled movement, it is standard as described in U.S. Pat. No. 3,553,395 of White to provide a dual dashpot damper that is connected to the vacuum-switch actuating rod. Such a damper comprises two pistons mounted on the axially extending actuating rod and reciprocal axially in respective compartments. The cylinder is formed in each compartment with a small radial port through which the fluid, typically the oil in which the entire system is immersed, is pumped as the piston moves back and forth. The restriction to flow constituted by each of the ports damps the motion of the pistons. When the ports are of different sizes, the damping action for one direction is different from that for the opposite direction.

Commonly owned U.S. Pat. No. 5,107,200 of Dohnal describes a switching system for a step transformer having at least two adjacent taps and a pair of terminals shiftable between the taps. The switching system or tap changer has a pair of fixed contacts normally connected to the terminals, a vacuum switch or interrupter connected between the terminals and displaceable between an open-circuit position and a closed-circuit position, a pair of movable contacts each engageable with a respective one of the fixed contacts and forming therewith a respective bypass switch, and a cam rotatable about a cam axis and having a contact face and an axially oppositely facing interrupter face each formed with a respective operating formation. A drive rotates the cam about its axis through steps of a half revolution. A respective cam follower engaged between each of the movable contacts and the contact-face formation opens and closes one of the bypass switches on rotation of the cam through a half revolution and thereafter opens and closes the other of the bypass switches on rotation of the cam through a succeeding half revolution. Another cam follower and a force-storage unit engaged between the interrupter and the interrupter-face formation snap the interrupter open and then snap it closed each time the cam is rotated through a half revolution. This system has a damper for movement of the actuating rod at the ends of its stroke. This damper includes a cylinder fixed on the housing and a piston carried on the rod and subdividing the cylinder into a pair of generally closed compartments. Each of the compartments is formed with a vent aperture of limited flow cross section.

Such dampers have certain disadvantages. Principally their reaction characteristics—movement speed, return rate, resistance force—vary considerably with temperature. This is mainly caused by the decrease in viscosity of the oil they use as the temperature of this oil increases. In the known switching environment, there can be considerable heat build up so that, for instance, a system that has sat for quite some time, so that it is basically at ambient temperature, heats considerably during a period of frequent tap changing. Thus to start with it will work sluggishly and cause the contacts to open and/or close late, whereas after some time there will be virtually no damping action.

Another problem with these systems is that it is very difficult to alter their damping characteristics. Thus if the application is changed, the entire damper must be switched out against a new one. Furthermore the known dampers are fairly bulky, especially in the axial dimension, so that accommodating them in the tight surroundings of a tap changer is fairly difficult.

OBJECTS OF THE INVENTION

It is therefore an object of the present invention to provide an improved damper for a tap-changer vacuum switch.

Another object is the provision of such an improved damper for a tap-changer vacuum switch which overcomes the above-given disadvantages, that is whose damping characteristic does not change significantly with temperature, that can be reset easily, and that is of simple, inexpensive, and compact construction.

SUMMARY OF THE INVENTION

A tap-changer vacuum switch having an actuating rod extending and displaceable along an axis is provided according to the invention with a damper having a damper housing offset from and fixed relative to the vacuum switch, and a rod piston fixed on the valve-actuating rod, in the damper housing, and defining in the damper housing a compartment whose volume changes as the rod piston moves axially with the rod. The damper housing is formed with a pair of radially open ports opening into the compartment. An in-only check valve fitted to one of the ports only permits fluid flow into the compartment, and an out-only check valve fitted to the other port only permits fluid flow out of the compartment.

The damper housing in accordance with the invention is formed at each port with an outwardly open seat. The check valves are retained by releasable means such as bolts in the respective seats. Thus they can easily be switched out for valves with different opening and closing characteristics.

The seats according to the invention are circular and identical. The check valves have identical end flanges fitting complementarily in the seats. Furthermore the valves can have opposite ends each formed with such a flange so that they can both be of identical construction, one simply mounted oppositely to the other. This further reduces the complexity of the system since for a given opening or closing pressure only a single valve need be stocked.

The valves can be held in place by collars or shoulders on respective retaining bolts that engage the respective end flanges and press same into the respective seats. Seal rings under the flanges prevent any unwanted leakage.

Each of the valves according to the invention includes a tubular valve housing formed with the respective flange and having one end formed with an inwardly directed valve seat, a cup-shaped valve piston displaceable in the valve housing into and out of engagement with the respective valve seat, and a spring in the valve housing urging the respective piston toward the respective seat.

Thus with this system the opening and closing pressures for these valves are largely determined by the constants of their springs. Since the spring constant is much less susceptible to change as its temperature changes, this means that the valves will perform uniformly whether hot or cold. Furthermore the check valves are mounted on the side of the damper housing, in a location where there is normally ample room, so that they do not make the overall assembly longer.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
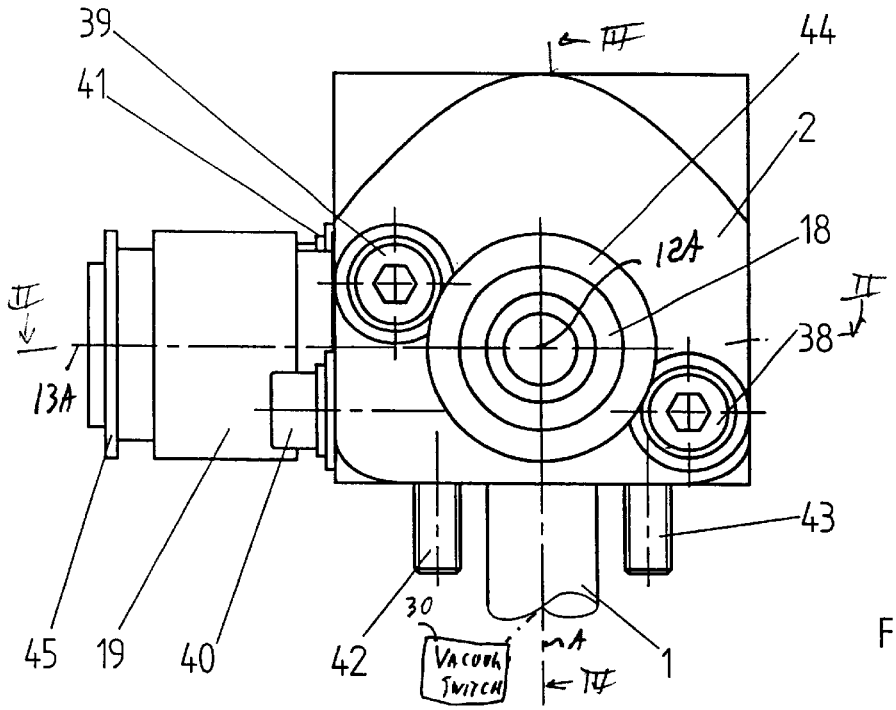
FIG. 1 is a side view of a damper according to the invention.
Figure 2:
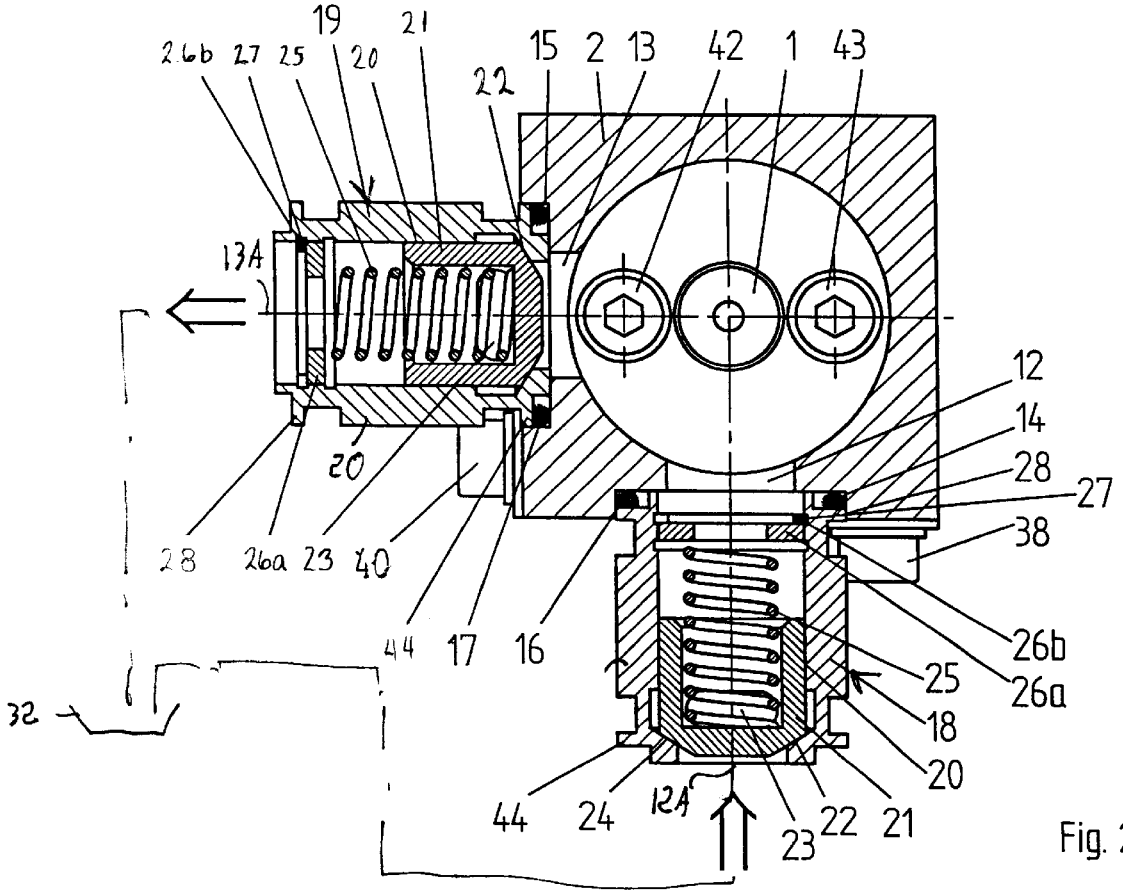
FIGS. 2 and 3 are sections taken along respective lines II—II and III—III of FIG. 1.
Figure 3:
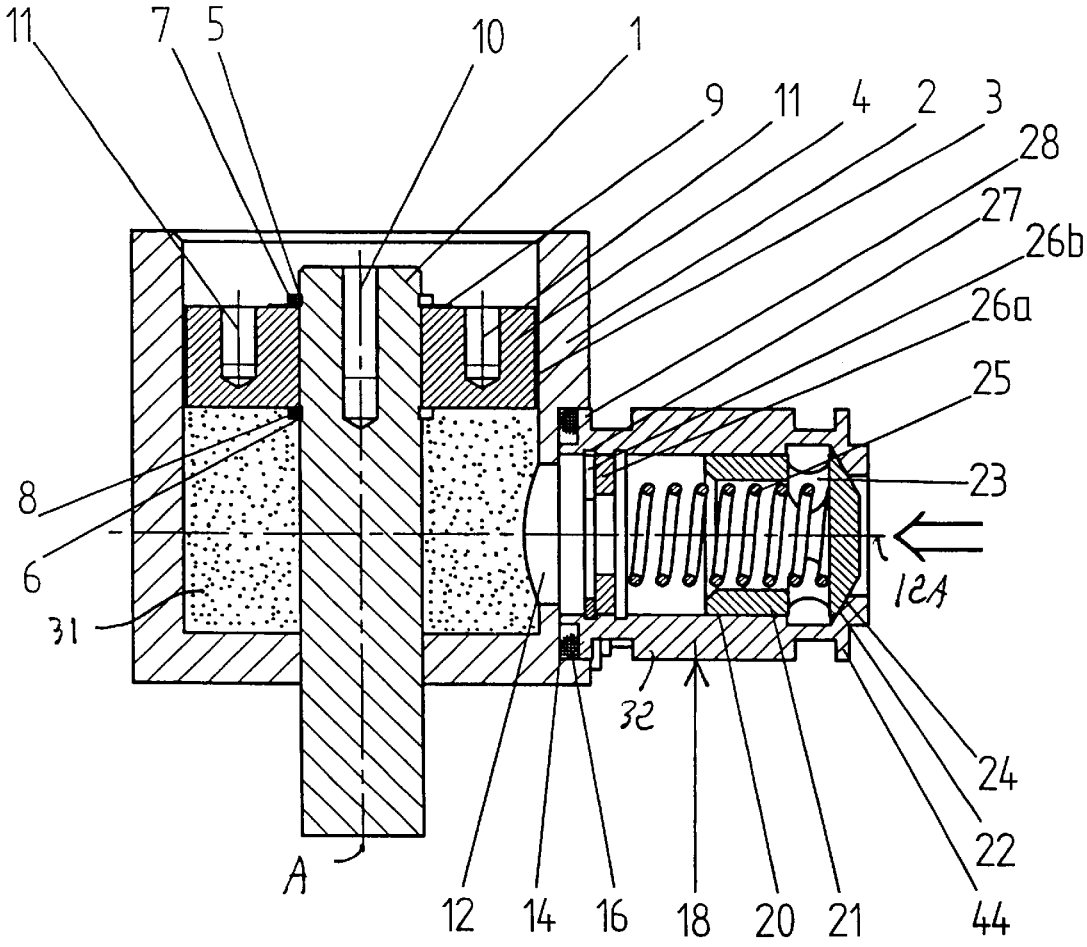

As seen in the drawing, an actuating rod 1 of a vacuum switch shown schematically at 30 in FIG. 1 extends along an axis A through a cylinder 3 of a damper housing 2 fixed on or relative to the switch 30. A piston 4 on the rod 1 forms in the cylinder 3 a compartment 31 filled with oil that normally completely surrounds the housing 2 or is otherwise provided from a supply such as shown schematically at 32 in FIG. 2. The piston 4 is held in place by a pair of snap rings 7 and 8 set in axially offset and radially outwardly open grooves 5 and 6 formed in the rod 1. A spacer disk or washer 9 may be provided between the snap ring 7 and the outer face of the piston 4. The end of the rod 1 is formed with an axially outwardly open threaded blind bore 10 and the piston 4 with similar bores 11 that serve for taking-apart the device. Bolts 42 and 43 in the end of the housing 2 axially secure the housing 2 relative to the vacuum switch 30 on fixed structure of the tap changer.

Figure 4:
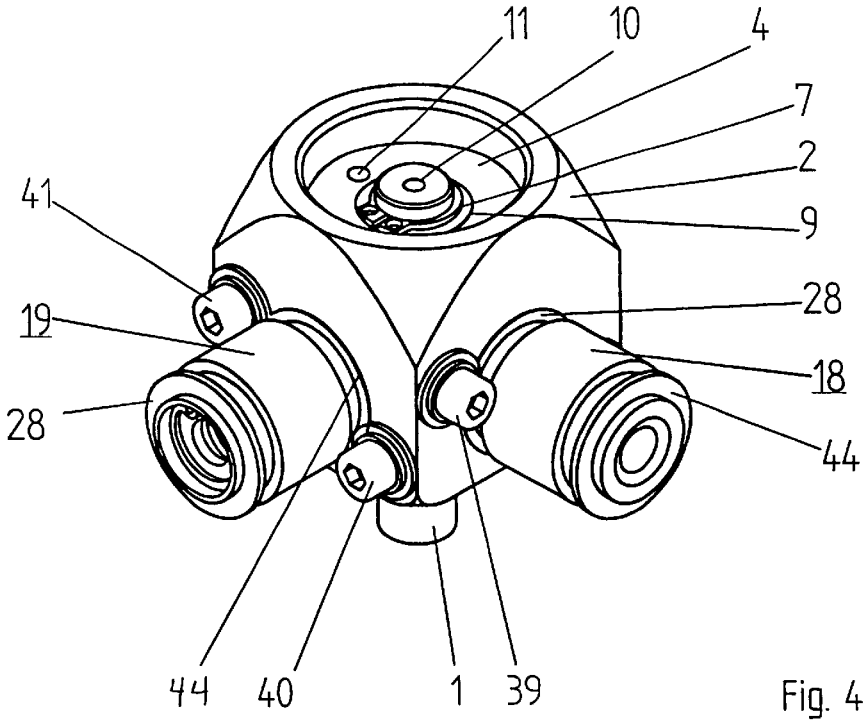
FIG. 4 is a perspective view of the damper.
Figure 5:
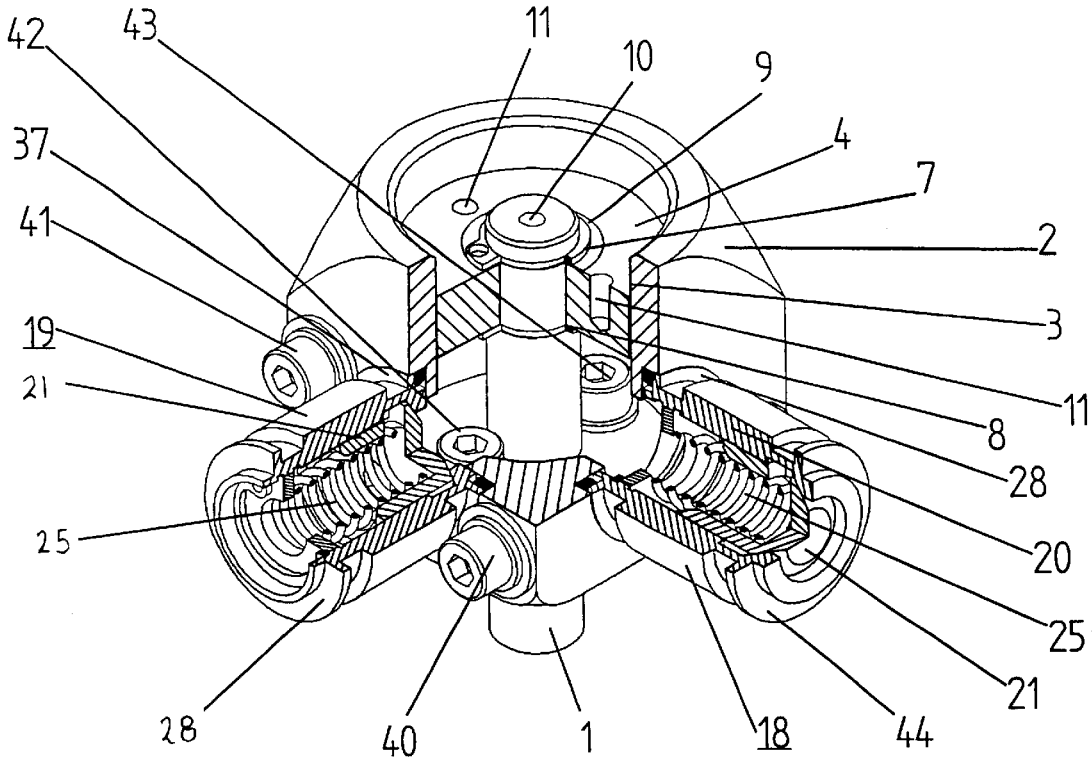
FIG. 5 is a view like FIG. 4 but partially in section.

The housing 2 is formed with two large-diameter radially throughgoing ports 12 and 13 centered on respective axes 12A and 13A and opening into respective outwardly open seats 14 and 15 receiving respective identical check-valves 18 and 19 and each having a cylindrical side wall coaxial with the respective port 12 or 13 and a planar end wall perpendicular to the respective axis 12A or 13A. The axes 12A and 13A lie in a plane perpendicular to the axis A and extend at 90° to each other. Each valve 18 and 19 comprises a tubularly cylindrical body 20 having at one end an annular and radially outwardly directed flange 28 and at its opposite end an identical such flange 44, both adapted to fit snugly and complementarily into the respective seat 14 or 15, with a respective O-ring 16 or 17 compressed between it and the floor of the respective seat 14 or 15. Screws 38 and 39 (See FIG. 4 also) engage the flange 28 of the valve 18 and lock it in the seat 14 and other screws 40 and 41 engage the flange 44 and fix the valve 19 in the seat 15. To this end the screws 38, 39, 40 and 41 have projecting rims that fit in the groove formed outward of the flanges 28 and 44.

Each housing 20 is internally formed at the end externally carrying the flange 44 with a frustoconical valve seat 24 engageable by a frustoconical end face 22 of a cup-shaped piston 21 urged by a spring 25 against the seat 24 and along the center axis of the respective housing 20. The opposite end of the spring 25 bears on a washer 26*a* bearing on a snap ring 26*b* seated in an inwardly open groove 27 formed in the housing 20 near the flange 28. The pistons 21 are each formed near their outer ends with a radially throughgoing hole or aperture 23 so that, when they are not engaging the respective seat 22, liquid can flow through the housing 20 and hole 23.

Although both of the valves 18 and 19 are of identical construction, the valve 18 is mounted with its flange 28 in the seat 14 so it functions as an in-only check valve and the other valve 19 with its flange 44 in the seat 15 so it functions as an out-only check valve. The pressures at which these valves 18 and 19 open and close are determined largely by the constants of their springs 25 which do not change significantly with temperature. Thus even though the oil in and around the system may vary widely in temperature, these valves 18 and 19 will continue to maintain the chamber 31 at a predetermined pressure and the damper will operate with uniform damping characteristics at the start and end of its stroke.

We claim:

1. In combination with a tap-changer vacuum switch having an actuating rod extending and displaceable along an axis, a damper comprising:

a damper housing separate from and fixed relative to the vacuum switch and formed with a pair of radial ports each in turn formed with a respective outwardly open circular seat, the seats being substantially identically shaped;

a rod piston fixed on the rod in the damper housing and defining in the damper housing a compartment into which the ports open and whose volume changes as the rod piston moves axially with the rod;

a pair of identical check valves each having a tubular valve housing having a pair of opposite ends, respective opposite end flanges complementarily fittable in the seats and formed at the housing ends, an inwardly directed valve seat at one of the ends, a valve piston displaceable in the valve housing into and out of engagement with the respective valve seat, and a spring in the valve housing urging the respective piston toward the respective seat; and respective means for retaining the check valves in the respective seats with the flange of the one end of one of the valves fitted to one of the ports for flow only out of the one port and the other end of the other valve fitted to the other port for flow only into the other port.

2. The vacuum-switch damper defined in claim 1 wherein the retaining means each engage one of the end flanges of the respective valves and press same into the respective seats.

* * * * *